US011898311B2

(12) United States Patent
Coots

(10) Patent No.: US 11,898,311 B2
(45) **Date of Patent: *Feb. 13, 2024**

(54) RAILROAD TIE PLATE DISTRIBUTION APPARATUS AND METHOD THEREFORE

(71) Applicant: B & B Metals, Inc., Shepherdsville, KY (US)

(72) Inventor: Coty T. Coots, Shepherdsville, KY (US)

(73) Assignee: B & B Metals, Inc., Shepherdsville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/701,564

(22) Filed: Mar. 22, 2022

(65) Prior Publication Data

US 2022/0213653 A1 Jul. 7, 2022

Related U.S. Application Data

(63) Continuation of application No. 16/433,720, filed on Jun. 6, 2019, now Pat. No. 11,299,859.

(60) Provisional application No. 62/685,050, filed on Jun. 14, 2018.

(51) Int. Cl.
*E01B 29/32* (2006.01)

(52) U.S. Cl.
CPC ..... *E01B 29/32* (2013.01)

(58) Field of Classification Search
CPC ..... E01B 29/24; E01B 29/26; E01B 29/32; E01B 29/38; E01B 29/40; E01B 29/44
See application file for complete search history.

(56) References Cited

U.S. PATENT DOCUMENTS

| | | | |
|---|---|---|---|
| 1,953,818 | A | 4/1934 | Paridon |
| 2,341,265 | A | 2/1944 | Crawford |
| 3,063,543 | A | 11/1962 | Schneider |
| 3,394,808 | A | 7/1968 | Thompson |
| 3,552,539 | A | 1/1971 | Rutter |
| 3,589,531 | A | 6/1971 | Povlacs |
| 3,930,595 | A | 1/1976 | Formanski |
| 4,583,635 | A | 4/1986 | Timmer et al. |
| 4,691,639 | A | 9/1987 | Holley |
| 4,896,835 | A | 1/1990 | Fahrenholz |
| 4,974,518 | A | 12/1990 | Cotic et al. |

(Continued)

FOREIGN PATENT DOCUMENTS

| | | |
|---|---|---|
| CA | 2810847 | 9/2013 |
| CA | 3046462 A1 | 12/2019 |

(Continued)

OTHER PUBLICATIONS

Transmittal of Related Cases.
Canadian Intellectual Property Office, Patent Application No. 3,046,462, filed Jun. 14, 2019.

*Primary Examiner* — Robert J McCarry, Jr.
(74) *Attorney, Agent, or Firm* — Dinsmore & Shohl LLP

(57) ABSTRACT

Present embodiments relate to a railroad tie plate distribution apparatus and method therefore. The tie plate distribution apparatus which may be used in manual or automatic distribution modes in order to place tie plates on a railroad tie in a spaced apart sequence as the apparatus moves over a track being serviced. The tie plate distributor includes an actuator to feed tie plates on to a railroad track system being serviced.

19 Claims, 6 Drawing Sheets

(56) References Cited

U.S. PATENT DOCUMENTS

| | | | |
|---|---|---|---|
| 5,037,286 | A | 8/1991 | Roberts |
| 5,038,914 | A | 8/1991 | Cotic et al. |
| 5,084,991 | A | 2/1992 | Cronk, Jr. |
| 5,165,520 | A | 11/1992 | Herve et al. |
| 5,210,999 | A | 5/1993 | Cosimati |
| 5,348,162 | A | 9/1994 | Wrobleski |
| 5,607,587 | A | 3/1997 | Langner |
| 5,913,402 | A | 6/1999 | Sakota et al. |
| 6,019,227 | A | 2/2000 | May, III |
| 6,360,894 | B1 | 3/2002 | Devlin et al. |
| 6,564,925 | B1 | 5/2003 | Cadwallader et al. |
| 7,497,337 | B2 | 3/2009 | Tse |
| 7,665,599 | B2 | 2/2010 | Stibbard |
| 8,166,883 | B1 | 5/2012 | Coots |
| 9,016,208 | B2 | 4/2015 | Coots |
| 9,038,542 | B2 | 5/2015 | Coots |
| 9,328,465 | B1 | 5/2016 | Coots |
| 9,422,673 | B2 | 8/2016 | Coots |
| 9,457,380 | B2 | 10/2016 | Davis |
| 11,299,859 | B2 * | 4/2022 | Coots ..... E01B 29/32 |
| 2004/0094188 | A1 | 5/2004 | Stalp |
| 2009/0048996 | A1 | 2/2009 | Sedore |
| 2009/0188406 | A1 | 7/2009 | Sperling |
| 2009/0218256 | A1 | 9/2009 | Rasmussen |
| 2011/0100248 | A1 | 5/2011 | Buckley et al. |
| 2011/0146526 | A1 | 6/2011 | Plyler et al. |
| 2012/0204752 | A1 | 8/2012 | Helmick |

FOREIGN PATENT DOCUMENTS

| | | | |
|---|---|---|---|
| EP | 0192594 | A1 | 8/1986 |
| EP | 0895949 | A1 | 2/1999 |
| EP | 0895950 | A1 | 2/1999 |

* cited by examiner

RAILROAD TIE PLATE DISTRIBUTION APPARATUS AND METHOD THEREFORE

CLAIM TO PRIORITY

This continuation patent application claims priority to and benefit of, under 35 U.S.C. § 120, U.S. Non-Provisional patent application Ser. No. 16/433,720, filed Jun. 6, 2019 and titled "Railroad Tie Plate Distribution Apparatus and Method Therefore", which claims priority to U.S. Provisional Patent Application Ser. No. 62/685,050, filed Jun. 14, 2018 also titled "Railroad Tie Plate Distribution Apparatus and Method Therefore", all of which is incorporated by reference herein.

BACKGROUND

1. Field of the Invention

Present embodiments relate to a railroad tie plate distribution apparatus and method therefore. More specifically, but without limitation, present embodiments relate to a tie plate distribution apparatus which may be used in manual or automatic distribution modes in order to place tie plates on a railroad tie in a spaced apart sequence as the apparatus moves over a track.

2. Description of the Related Art

Railroad tracks generally consist of two parallel steel rails, which are laid on railroad ties. Railroad ties are normally laid on a bed of coarse stone known as ballast, which combines resilience, some amount of flexibility, and good drainage characteristics. Railroad ties spread the load from the rails over the ground and also serve to hold the rails a fixed distance apart. The railroad ties are generally spaced apart a distance of about twenty-two inches on center although the distance may vary. On an upper surface of the railroad tie, is a tie plate or base plate. The tie plate connects the rail and the tie. Fasteners, such as spikes, screws or the like are often driven through a hole in the tie plate to hold the rail. Alternatively the rails may be clipped to the tie plates.

The steel rails can carry heavier loads than any other material. The rails generally have a foot, a web extending upwardly from the foot and a head. Additionally, the rails are spaced apart a preselected distance corresponding to wheel spacing of trains. The preselected distance between rails is known in the art as the gauge distance.

Construction and repair of existing railroad tracks requires distribution of tie plates at locations where railroad ties are positioned. The maintenance and repair of tie plates is labor intensive and the weight and forces of the work can result in numerous injuries including but not limited to back injuries and crushed appendages.

It would be desirable to automate the distribution process in a way to reduce the number of injuries. Further, it would be desirable to reduce the number of workers needed to position the tie plates where needed. Still further it would be desirable to accurately position the tie plates in order to decrease the amount of manual labor necessary for positioning or placement of the tie plates on the railroad ties.

The information included in this Background section of the specification, including any references cited herein and any description or discussion thereof, is included for technical reference purposes only and is not to be regarded subject matter by which the scope of the invention is to be bound.

SUMMARY

The present application discloses one or more of the features recited in the appended claims and/or the following features which alone or in any combination, may comprise patentable subject matter.

The instant tie plate distribution system deposits tie plates on railroad ties in an automated fashion by sequentially staging the tie plates and depositing them in a desired location along the railroad track. The tie plates are staged and moved to a distribution zone which moves the tie plates to a position above the railroad ties and deposits them on the railroad ties. This deposit may occur by sensing the tie or manually actuating the tie plate when ready.

According to some embodiments, a tie plate distributor comprises a conveyor having a first end and a second end, a stop near a second end of the conveyor, the stop being movable to allow advancing of a tie plate in a distribution zone. A second stop may be disposed in the distribution zone, the second stop biased to a blocking position. An actuator may engage a tie plate and force the tie plate past the second stop.

According to some optional embodiments, the following options may be used either individually with the previous embodiments, or in combination with one another and the previous embodiments. The distribution zone may have a frame. The second stop may be a first support and a second support. The second stop may be pivotal for movement from a first position to a second position, wherein one of the first and second positions is the blocking position. The tie plate distributor may further comprise a spring disposed between a fixed position and the second stop. The tie plate distributor may further comprise an optional magnet disposed on the actuator, the magnet retaining or releasing the tie plate. The actuator may push the tie plate and the tie plate may push the second stop open. The magnet may be one of a permanent magnet or an electromagnet. The magnet may retain the tie plate at a third stop and releases the tie plate on to a railroad tie. The tie plate distributor may also comprise a gripping device at an end of the actuator. The tie plate distributor may further comprise a sensor which is operably connected to one of the actuator or the magnet. The tie plate distributor may further comprise a manual switch to actuate at least one of the actuator or the magnet. The tie plate distributor further comprises a second sensor which is operably connected to the magnet.

According to some embodiments, a method of distributing tie plates comprises the steps of moving a tie plate to a first stop position, moving the tie plate from the first stop position to a second stop position within a distribution zone, actuating an actuator to move the tie plate out of the second stop position and through a second stop, biasing the second stop back to its first position independent of the actuator, and, moving the tie plate on to a railroad tie.

According to some optional embodiments, the following optional steps may be used either individually with the previous method, or in combination with one another and the previous embodiments. The method may further comprise sensing a position of the railroad tie plate. The method may further comprise manually actuating one of the actuator or a magnet. The method may further comprise releasing the tie plate on to the railroad tie.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE DRAWINGS

In order that the embodiments may be better understood, embodiments of a tie plate distribution apparatus and method therefore will now be described by way of examples. These embodiments are not to limit the scope of the claims as other embodiments of a tie plate distribution apparatus will become apparent to one having ordinary skill in the art upon reading the instant description. Non-limiting examples of the present embodiments are shown in figures wherein:

DETAILED DESCRIPTION

Figure 1:
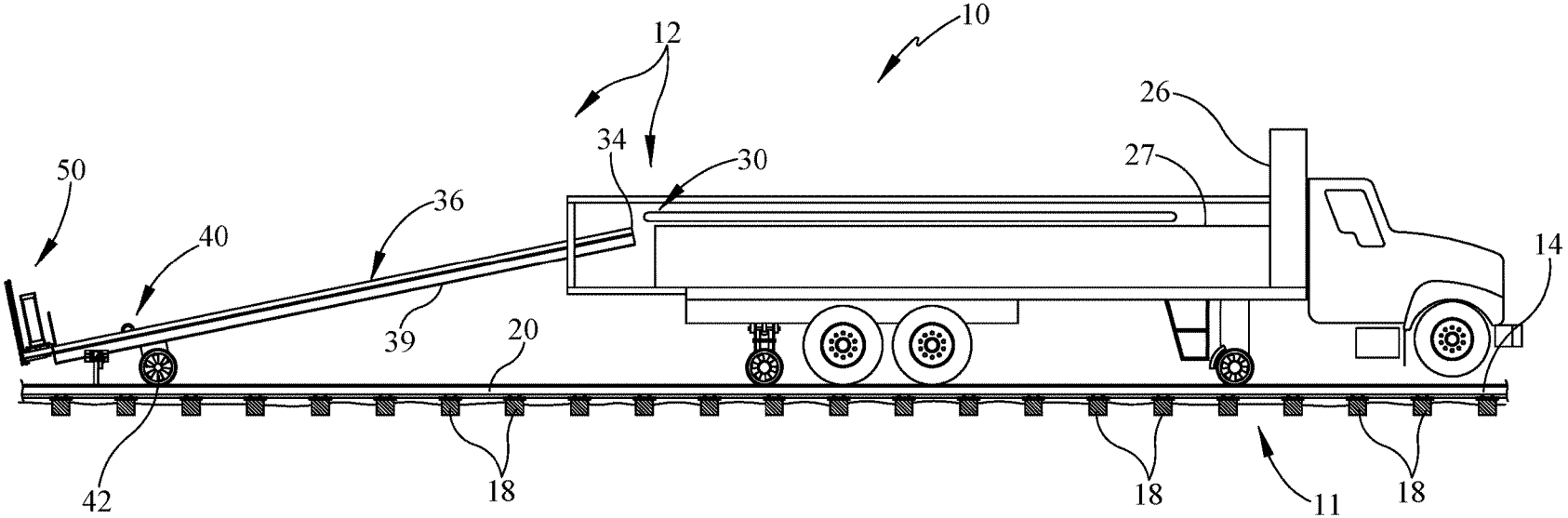
FIG. 1 is a side view of a tie plate distributor which may be mounted on powered vehicle.

It is to be understood that the tie plate distribution apparatus and method therefore is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-9 various aspects of a tie plate distribution apparatus and method thereof.

Figure 3:
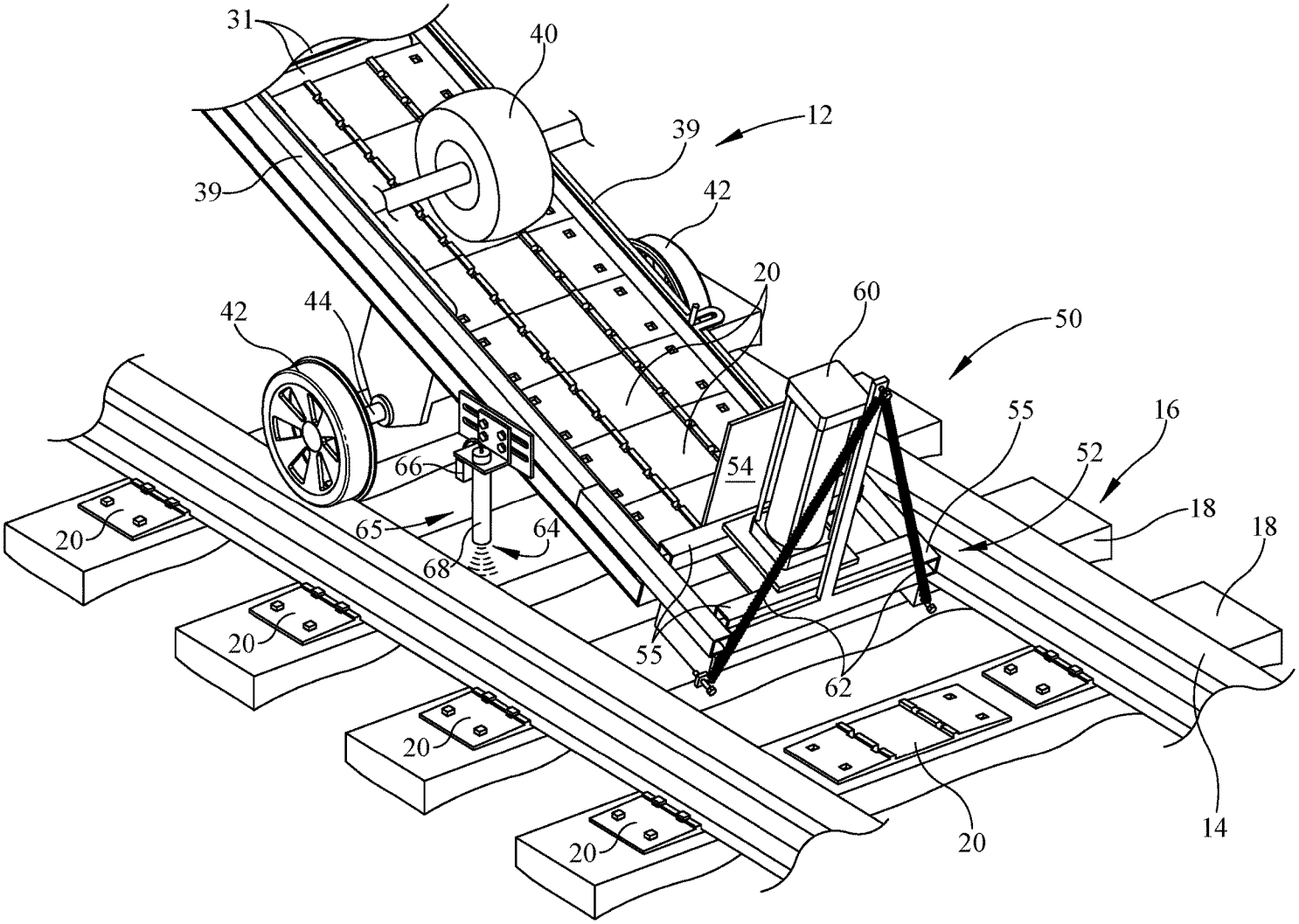
FIG. 3 is a perspective view of the tie plate distributor positioned on a railroad track system.

Referring initially to FIG. 1, a side view of a tie plate distributor 12 is depicted. A carrier vehicle 10 is partially shown located on a railroad track 14 of a railroad track system. Beneath the railroad track 14, a ballast 16 provides a substrate upon which a plurality of railroad ties 18 are disposed. The ballast 16 may be formed of rocks or other material which provides a stable base and allows for proper drainage. Further, the ballast 16 may have an upper elevation which raises the railroad to a height out of known flood plains. The railroad ties 18 are generally positioned about twenty-two inches (22") apart, as is known in the art however, alternative spacing may be utilized depending on the railroad operator and/or other factors. The railroad ties 18 are generally rectangular having a square cross-section as shown in FIG. 1. Disposed on an upper surface of each railroad tie 18 are a plurality of tie plates 20 (FIG. 3). The tie plates 20 are anchored to the railroad tie 18 and provide a place for positioning of the railroad track 14. Although a single track 14 is shown in the side view, as one skilled in the art will understand that in some embodiments, two tracks are laid in parallel fashion and spaced apart at a preselected gauge distance providing the railroad track system. Also, in other embodiments, a single track may be utilized with a custom machine having supports of, for example, tracks or wheels on the side opposite the rail.

Figure 2:
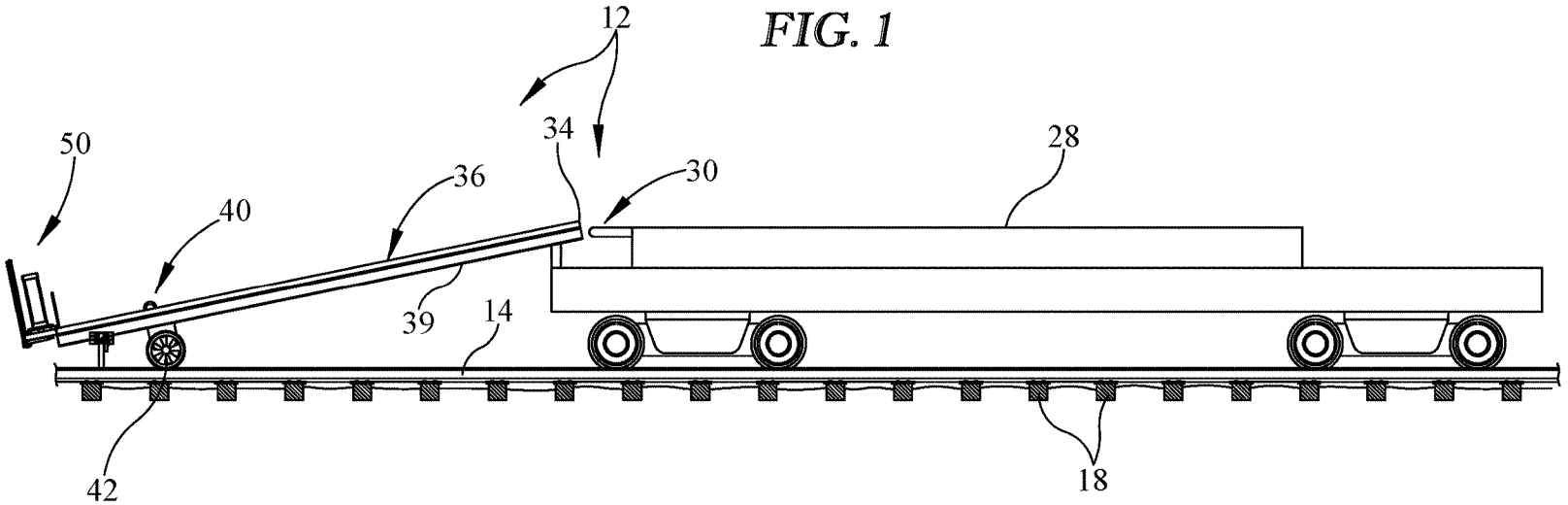
FIG. 2 is a side view of a tie plate distributor which may be mounted to a rail car vehicle.

There is also shown in one embodiment, a tie plate distributor 12, for sequentially unloading railroad tie plates 20 (FIG. 3) from a suitable tie plate carrier, such as the railroad track mounted truck 26, as shown in FIG. 1, or a modified rail car 28 as shown in FIG. 2. The tie plate distributor 12 may be used with or on, either of the powered vehicle 26 or the rail car 28. As best shown in FIG. 3, the tie plate distributor 12 is adapted to deposit the plates 20 along a railroad tracks 14 of the railroad system. In some embodiments, it may be desirable to deposit one of the plates 20 along a centerline of the railroad track system on the railroad ties 18. In some other embodiments, it may be desirable to position the tie plates 20 on the railroad ties 18 near ends of the ties 18, or on the ballast 16 near ends of the railroad ties 18, if necessary. Conventionally, a straight portion of the railroad track 14 will have cross-ties 18 laid on longitudinal centerlines which are about twenty-two inches (22") apart, as measured along railroad track 14. As the tie plates 20 are deposited, one or more workmen who follow behind the distributor 12 may replace old tie plates on each individual tie 18 after the old railroad track 14 have been removed with the new tie plates 20, preparatory to placement of new rails or replacement of old railroad track 14 on the newly placed tie plates.

The tie plate distributor apparatus 12 includes a first, tie plate loading end portion, which is mounted on the bed of the truck 26, for example, and a second, tie plate unloading end portion which is supported on railroad wheels 42, as best shown in FIGS. 1, 2 and 3. The tie plate loading end portion of the apparatus 12 can include a conventional motorized endless belt conveyor, generally designated 30, for transporting the plates 20 rearwardly (from right to left, as viewed) from a front and mid-portion to a rear portion of the truck bed 27. The conveyor 30 can be positioned at a convenient height above the truck bed 27 so that one or, perhaps, two workers standing on opposite sides of the conveyor 30, can readily pick up the tie plates 20 from storage along each side of the truck bed 27, place them on the moving belt conveyor 30 and, preferably, orient them for disposition on the railroad ties 18. Further, it should be understood that a hopper, conveyor or other mechanical or electromechanical device may be used to deliver the tie plates to the conveyor 30 or to the tie plate distributor 12.

A drive motor (not shown) for the belt conveyor 30 can be of the usual 12 vdc electric type so as to be energized by an engine driven electrical system of the truck 26. But, in order to avoid overtaxing a battery of the truck 26, it is also possible in some embodiments to use a separate gasoline powered motor/generator set to power a 120 vac drive motor of the belt conveyor 30. Where the rail car 28 of FIG. 2 is used for carrying the loading end portion of the apparatus 12, a suitable gasoline powered motor/generator set, can also be used as a satisfactory energy source for the drive motor of the conveyor 30.

The belt conveyor 30 delivers the tie plates 20 onto a first, upper input end 34 of a diagonally downwardly and rearwardly sloping gravity feed, roller conveyor, generally designated 36. The slope of the conveyor 36 is suitable at about 10 to 40 degrees from horizontal, and in some embodiments, 20 to 30 degrees, however other ranges may be utilized. The conveyor 36 includes a series of parallel and closely spaced apart cylindrically shaped rollers 31 (FIG. 3) of conventional type which are freely rotatable about their longitudinal axes, as for example, on conventional bearings. The rollers 31 are suitably journaled in opposing and parallel extending side beams or rails 39, which may be angle irons or channel beams for non-limiting example. The tie plates 20 thus are conveyed by gravity along the rollers 31 until intercepted by a device such as, for example, an inflatable pneumatic tire 40. The tire 40 is mounted above a central part of several of the rollers 31 and may be connected by a gear chain to an axle of the railroad wheels 42 for rotation as a function of rotation of the railroad wheels 42. In some embodiments, other configurations such as a motor—electric or hydraulic—may be used to rotate the tire 40 and advance the tie plates 20 on the conveyor 36.

In the alternative, an inclined chute with a metal base could be substituted in place of the roller conveyor 36 provided it is operatively inclined at a sufficient angle to assure that the tie plates 20 placed on an upper input end thereof will readily slide downwardly along the base for individual capture by the tire 40 and subsequent release to the track bed. Clearly, the angle of incline in such a chute would need to be greater than that of the conveyor 36. In other embodiments a vibratory feeder may also be used instead of the roller conveyor or chute. As used herein, the term conveyor may include, but is not limited to, any of these examples of structures which move tie plates—roller conveyor, powered conveyor, belt conveyor, chute, vibratory feeder, or the like.

The tire 40 rotates with the railroad wheels 42 but in an angular direction which is opposite that of the rollers 31 when transporting the tie plates 20 thereon. As the tie plates 20 are gravity fed down the rollers 31, a tread of the tire 40 engages and bears downwardly on one of the plates 20 at a time, thus pinning or capturing that plate 20 against the underlying rollers 31. Upon initial engagement of the tire 40 with a given one of the plates 20, the tire 40 must rotate some preselected distance on its axle each time the railroad wheels 42 move the desired tie plate drop distance, i.e. every eleven inches in the present example, along the railroad tracks 14 where the tie plates 20 are to be replaced under both of the railroad tracks 14 or every twenty two inches where the tie plates 20 under only one of the railroad tracks 14 are to be replaced. In this way, a different one of the tie plates 20 will pass completely under and become released from contact with the tire 40 each time the wheels 42 have moved eleven or twenty-two inches (22") along the railroad tracks 14, as the particular case requires.

After release of each of the plates 20 by the tire 40, the plate 20 freely gravitates off of a lower output end of the conveyor 36 for disposition along a centerline of the railroad tracks 14. It is recommend that a discharge end of the conveyor 36 be positioned at a height of about 3-4 inches above the track bed such that the plates 20 will not flip over or bounce out of the alignment as shown (FIG. 3). Accordingly, once the apparatus 12 is indexed so as to drop one of the plates 20, either on one of the ties 18, or mid-way between two adjacent ties, and the tire 40 is adjusted to make one full rotation while the wheels 42 are traveling a desired plate drop distance along the railroad tracks 14 the plates 20 will thereafter be discharged with the desired spacing. The apparatus 12 will deposit all other ones of the plates 20 at the desired locations and with the desired spacing. As shown in FIG. 3, the plates 20 gravitating down the conveyor 36 will usually back up in front of the tire 40, one next to another, depending on how rapidly such plates are loaded onto the belt conveyor 30 and how rapidly the belt conveyor 30 is moving to discharge them onto the conveyor 36.

It may be necessary to adjust the speed of travel of the belt conveyor 30 to synchronize closer to the speed of rotation of the tire 40, and, hence, the speed of rotation of the wheels 42 in order to prevent the plates 20 from backing up along the conveyor 36 in front of the tire all the way to the input end 34. A back-up of, say, about four of the plates 20 in front of the tire 40 at all times should assure even spacing between the plates being deposited along the railroad track 14. Of course, sometimes the back-up might grow to seven or eight of the tie plates 20 while at other times the back-up might drop as low as two or three. A visual inspection of the back-up by workers standing in the bed of the truck 26 will readily determine whether their rate of loading the tie plates 20 on the belt conveyor 30 is too great or too small or whether the speed of the belt conveyor 30 or, for that matter, the speed of the truck 26 along the railroad track 14 should be increased or decreased. In many cases, merely reducing the rate at which the tie plates 20 are being placed on the conveyor 30 by the workman will prevent back up of the plates behind the tire 40 from becoming too great.

Referring now to FIG. 3, a perspective view of the second, lower end of the tie plate distributor 12 is depicted. The distributor 12 includes the conveyor 36 wherein the tie plates 20 are sequentially positioned for delivery to a distribution zone 52. The tie plates 20 are shown with long axis oriented in a lateral manner, extending between the railroad tracks 14. In other embodiments, however, the tie plates may also be oriented in longitudinal direction, extending parallel to the railroad track 14 direction. Other delivery structures may also be utilized.

At the second, lower end of the rails 39 is a frame 50 which at least partially defines the distribution zone 52. The frame 50 may be defined in the instant embodiments by a plurality of structures 55, which may be for example tubes or other structures arranged in a manner to allow for receipt of the tie plates 20 into the distribution zone 52. The frame 50 may also be defined by a box-like structure which is fully or partially enclosing the lower area of the distributor. The frame 50 may form an enclosed area or an area which is open for monitoring of the tie plates moving through. A first stop 54 is moveable between a first position and a second position wherein one of the first and second positions allows feeding of a single tie plate into the distribution zone 52 and wherein the other of the first and second positions of the first stop 54 inhibits further movement of tie plates 20 from the tie plate distributor 12 into the distribution zone 52.

The stop 54 may be defined by various structures moved to block the pathway of movement of the tie plates 20 along the conveyor 30 and the distribution zone 52. In the instant embodiment, the stop 54 is defined as a plate which moves to allow tie plates 20 to move into the distribution zone 52 or blocks movement thereof.

Adjacent to the first stop 54 is an actuator 60. In the instant embodiments, the actuator 60 pneumatic, hydraulic, electric, or some other type of other driven actuator which provides movement. The actuator 60 is connected to the stop 54 in order to raise or lower the first stop 54. The actuator 60 provides linear movement which likewise creates linear movement for the first stop 54.

Also, within the distribution zone 52 and as the actuator 60 moves down, a tie plate located in the distribution zone 52 is forced outwardly from the distribution zone 52. According to the instant embodiment, the movement of the actuator 60 causes the tie plate within the distribution zone 52 to move downward from within the frame 50 and within the area generally created by the plurality of structures 55.

Figure 4:
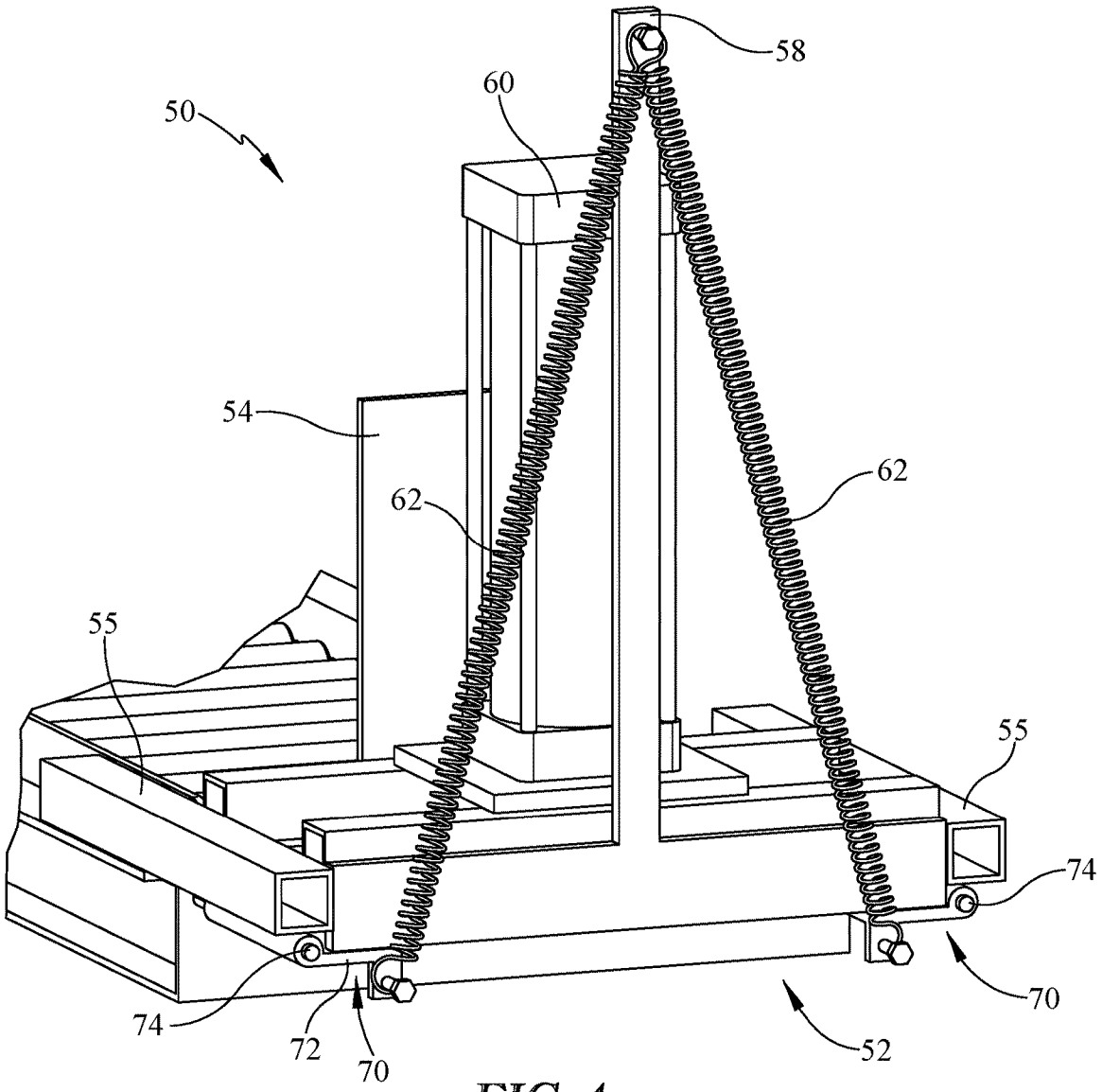
FIG. 4 is a rear perspective view of a tie plate distributor with the conveyor removed, wherein the second stop is disposed in a first position.

To the rear of the frame 50 is at least one spring 62. The springs 62 are connected at one end to a fixed location of the frame 50 and at a second end to a second stop 70 (FIG. 4). When the actuator 60 and the tie plate 20 in the distribution zone 52 is forced downwardly through the second stop 70 and beneath the frame 50 onto the railroad tie 18 or to an optional third stop 82 (FIG. 8), generally defined as a limit position of the actuator 60 and may be defined by, non-limiting example, a magnet 80 (FIGS. 7-9) which retains the tie plate until releasing or depositing on an adjacent railroad tie 18.

The distribution zone 52 functions as a gate assembly to control the discharge of tie plates to the railroad ties 18. The tie plate distributor 12 and specifically the components in the distribution zone 52 discharges the tie plates 20 from the conveyor 36 onto the railroad ties 18 beneath the second end of the conveyor 36 as the conveyor 30 moves along the railroad tracks 14. The gate function may work in combination with a sensor assembly 65. The sensor assembly 65 detects in-service tie plates 20, ties 18, or the absence of ballast material 16 indicating a servicing location, as the feed conveyor 30 moves along the railroad track 14. Alternatively, the sensor assembly 65 may function by detecting an edge of a railroad tie 18. When the sensor assembly 65 detects an in-service tie plate 20 (not yet removed from the railroad tie) or an edge of the railroad tie 18, the actuator 60 is signaled and operates to function in one of the following manners. In some embodiments, the actuator 60 may move a plunger from a first position, for example where the first stop 54 is in a blocking position, to a raised or unblocking position. In this unblocking position, one of the tie plates 20 of the conveyor 36 may advance into the distribution zone 52. Next the actuator 60 may move back to the blocking position and in doing so, may force a tie plate 20 which, moved into the distribution zone 52, out of the distribution zone for subsequent discharge on to the detected railroad tie or an adjacent tie. The detected tie or adjacent tie may be dependent on the spacing and/or timing associated with and/or between a discharge location and the sensor location, as well as the speed of the movement of the tie plate distributor 12.

In other embodiments, the sensor 64 may be used to signal the down stroke which forces the tie plate in the distribution zone out toward the railroad tie 18. Various configurations may be used to detect a portion of the railroad track system and subsequently create a motion of the actuator 60. Additionally, one skilled in the art will recognize that additional sensors may be utilized to direct different portions of the actuation process. For example, one sensor may be used to cause a first actuation of the actuator 60, and a second sensor used to cause a second actuation, instead of one sensor actuating a cycle of actuator movements.

The ejection may be signaled by the sensor assembly 65. The sensor assembly 65 comprises a housing 68 wherein a sensor 64 is positioned. The sensor 64 is in electronic communication with a controller 66 which receives signals from the sensor 64 and directs the gate assembly or distribution zone 52 to actuate. The sensor assembly 65 may be located at various locations along the feed conveyor 30. As depicted the sensor assembly 65 is adjacent the output end of the feed conveyor 30 near the distribution zone 52, however, the sensor assembly 65 or at least the sensor 64 and housing 68 may be positioned forward of a release point so that when an in-service tie plate 20 is detected a replacement tie plate 20 may be deposited from the feed conveyor 30 onto or adjacent a tie 18. In other words, the distance between the sensor assembly 65 and the release point may be substantially equal to the distance between two adjacent ties 18.

Referring now to FIG. 4, a rear perspective view of the frame 50 is depicted. The frame 50 is shown having a plurality of structures 55 which, in some embodiments, may be defined by tubes. The structures may be arranged in vertical and/or horizontal orientations to provide a base which defines the distribution zone 52. From this perspective, the tie plates 20 are delivered from the opposite side of the frame 50 then is depicted. The frame 50 may also be formed of various other structures such as plates, channels or stock materials, any of which may be utilized to mount the actuator 60.

The actuator 60 may be oriented in various manners in order to force a tie plate 20 from the distribution zone 52. The instant embodiment utilizes a linear actuator 60 which is oriented vertically and may include a plunger which moves downwardly from the structure of the actuator 60 which is depicted. Accordingly, the plunger of the actuator 60 may move downwardly forcing a tie plate 20 to move from a lower area of the frame 50. Various types of actuators may be utilized, including pneumatic, hydraulic, electric, or other devices. Additionally, actuators which may rotate to provide a linear motion may also be utilized. Still further, while the actuator 60 is mounted in a vertical orientation, the actuator 60 may be mounted in a horizontal fashion to actuate and place the tie plates 20 horizontally rather than vertically onto the railroad ties 18.

Still further, extending upwardly from the frame 50 is a spring mount 58. The spring mount 58 may have multiple apertures 59 to which a fastener may be positioned to adjust spring tension of the springs 62. At the lower end of the springs 62 is the second stop 70. The second stop 70 may be defined by first and second supports 72, according to non-limiting, illustrative embodiments. The supports 72 may be formed of plates, stock, or other structural shapes which support a tie plate 20 in the distribution zone 52 before the tie plate is discharged therefrom. The frame 50 further comprises pivots 74 to which the supports 72 are connected and defining the second stops 70. The lower ends of the springs 62 are connected to the second stop 70 so that the second stop 70 is biased in one direction, for example the supporting direction, but may be rotated downwardly to a non-supporting position as the tie plates 20 are pushed downwardly by the actuator 60. Once the tie plate 20 clears the edges of the second stop 70, specifically the edges of the supports 72, the spring biasing force pulls the supports 72 upwardly to a supporting position again.

It should also be understood that variations in the second stop 70 may be provided. For example, while the instant embodiment provides the two supports 72 at lateral sides of the distribution zone 52, it is also possible to move the supports to either or both of the forward and rearward ends of the distribution zone 52. Further, while two supports 72 are provided to define the second stop 70, a single stop may be provided. Still further while the term support is utilized, it should also be clear that support should not be limited to support from beneath the tie plate in the distribution zone 52. Instead the tie plate may be supported from any of various sides.

It should also be understood that while the biasing force is provided by the springs 62, other devices may be used to provide the biasing or movement of the second stop 70. For example, pneumatic, hydraulic or electric actuators may be used to create movement. Further, such alternatives may be actuated in a manner so not to interfere with actuation of the actuator 60. While the depicted embodiment utilizes passive second stop 70 and only moves when acted upon, alternate embodiments may be active so that the second stop moves when signaled rather than forced.

Figure 5:
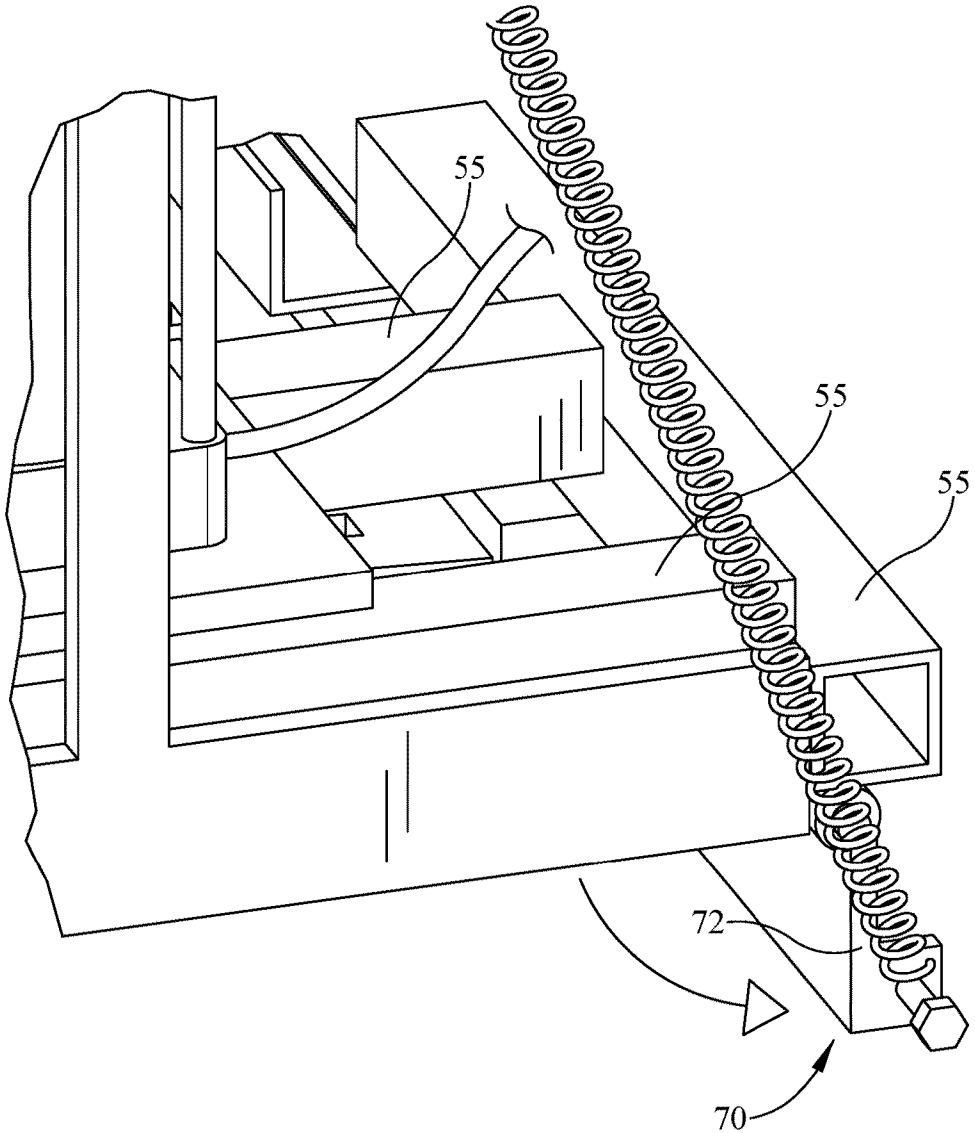
FIG. 5 is a rear perspective view of the tie plate distributor with the conveyor removed, wherein the second stop is disposed in a second position.

With reference now to FIG. 5, such motion is shown. The one support 72, defining one of the second stop 70, is shown pivoted downwardly. In this position, the tie plate 20 has moved or is moving from the distribution zone 52 downwardly toward a railroad tie 18. As is also shown in this view, the spring 62 is extended depicting that the spring is stretched from its normal position due to the movement of the tie plate 20 past the second stop 70. Various structures may be used to connect the spring 62 and the second stop 70. In the depicted embodiment, a fastener is utilized. The second stop 70 moves upon force applied when the tie plate is moved through this area. Without a tie plate in position, according to some embodiments, the actuator 60 does not control movement of the second stop 70. Thus, further, according to some embodiments, the sensor or manual actuation of the actuator 60 does not control the movement of the stop 70. Instead, a tie plate 20 must be present to cause movement of the second stop 70.

Figure 6:
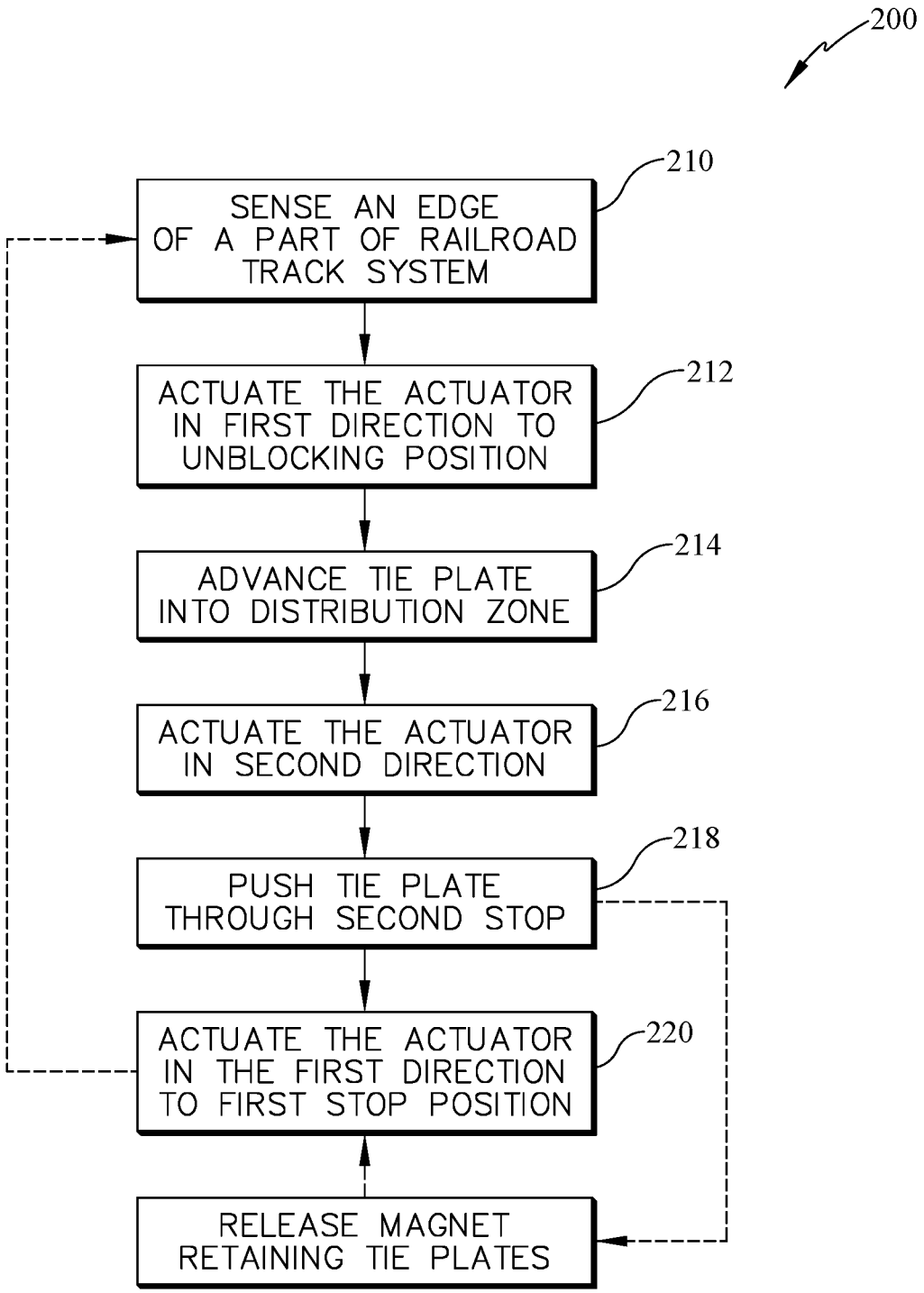
FIG. 6 is a flow chart for a method of operation of the tie plate distributor.

Referring now to FIG. 6, a flow chart is provided to describe an illustrative, non-limiting process. The process 200 begins with the tie plate distributor on rail tracks 14 by sensing an edge of a railroad tie 18, or other portion of the railroad track system at step 210. When the railroad tie 18 or other portion of the system is sensed. In some embodiments, the system may be manually actuated by a worker who actuates a switch or button periodically when the distributor is in the desired position. Stiff further, in other embodiments, the system may be actuated with a mechanical switch which engages a portion of the railroad track system, such as the railroad tie. Any of these steps may occur, or combinations thereof, may be utilized.

According to a next step 212, the sensing of the railroad tie for example, causes an actuation of the actuator 60, by way of a signal for example. The actuator 60 may be moved from a first position, for example a blocking position, to a second position, for example an unblocking position, so that a tie plate 20 may move from the conveyor 36.

In the next step 214, a tie plate 20 is moved from a tie plate advances from the conveyor 36 into the distribution zone 52 defined within the frame 50 of the tie plate distributor 12. Once the tie plate 20 moves therein, the actuator 60 is actuated again at step 216 from the second position to the first blocking position, by actuating in the second direction. It should be understood to one skilled in the art that the actuator being moved refers to the plunger portion of the actuator 60 being actuated relative to the remainder of the actuator.

Once the tie plate 20 is in the distribution zone 52, the actuator 60 pushes the tie plate through the second stop 70 at step 218 as the actuator 60 moves to or through the first blocking position.

Optionally, at step 220, the actuator 60 may be moved in the first direction to the stop position or alternatively, the actuator 60 may remain in its current position which also stops movement of tie plates 20 into the distribution zone 52.

According to some other optional embodiments, when the tie plate is forced through the second step 218, it may be desirable retain control of the tie plate before placing such on the railroad tie 18, or other desired location. One manner of retaining such control is to provide a magnet at the end of the actuator plunger, so that the tie plate is retained thereon. In this optional embodiment, the tie plate may be retained by the magnet until the tie plate is positioned over the desired location, for example of the railroad tie. Then, according to step 222, the magnet may release the retained tie plate. This may be done by sensor, switch or manually for example by a worker actuating a switch or button. This step is shown in broken line and broken box as it is an optional step. In other embodiments, the magnet may alternatively be some other retaining structure such as a gripper which has the capability of holding the tie plate until signaled to release the tie plate 20 on to the desired location, for example the railroad tie 18. Likewise, the process 200 may continue in a variety of way by returning to the step 210 so that the next sequenced tie plate may be moved into the distribution zone 52 and the method 200 continue.

Figure 9:
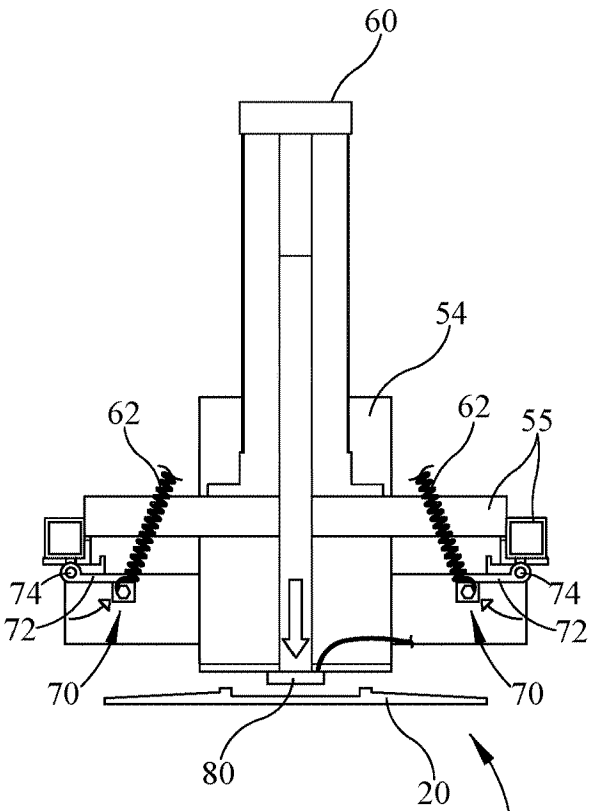
Figure 8:
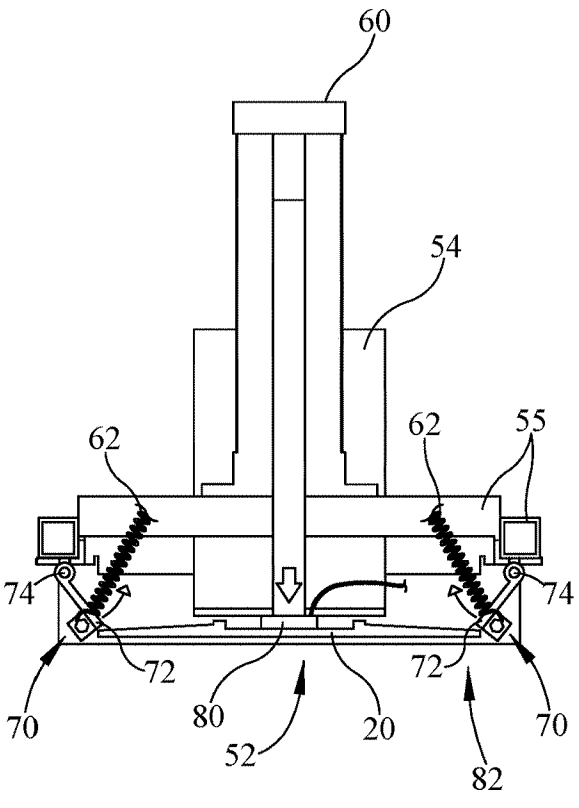
FIG. 8 is a second sequence view of the operation of the tie plate distributor; and, FIG. 9 is a third sequence view of the operation of the tie plate distributor.
Figure 7:
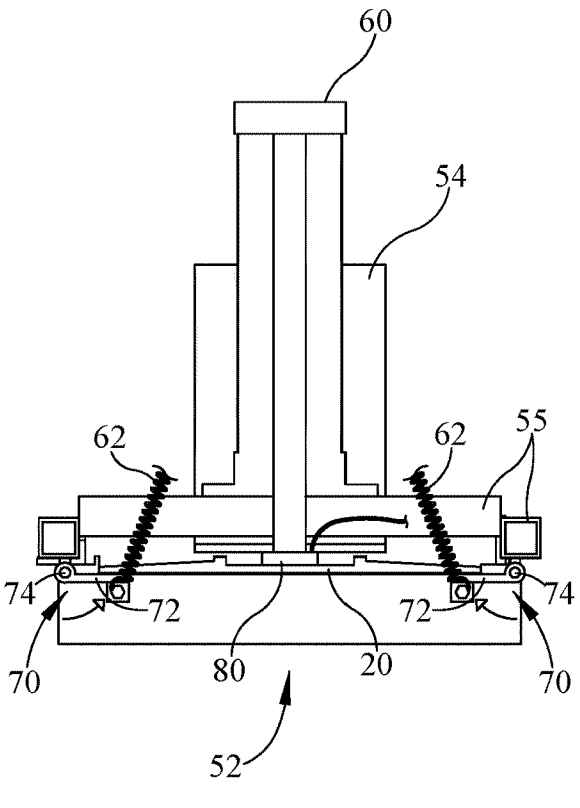
FIG. 7 is a first sequence view of the operation of the tie plate distributor.

With reference now to FIGS. 7-9, an additional component of the tie plate distributor 12 is provided an optional magnet 80 may be utilized on the actuator 60, for example the plunger or piston portion thereof, to retain tie plates up to a desired position. The magnet 80 may be one or more magnets and may be a permanent magnet or may be powered electromagnet, as shown in the figures having a wire extending from the magnet 80. The magnet 80 may be operably connected to the sensor 60 or may be connected to an additional sensor which only services the magnet. Alternatively, in some embodiments a worker may follow the tie plate distributor 12 and actuate a switch or button when the magnet is to be de-powered and release the tie plate being held in position. Again however, the magnet 80, or other gripping device, is optional and therefore may or may not be utilized.

With reference still to FIGS. 7-9, a sequence of views is shown depicting the operation of the tie plate distributor 12. With reference first to FIG. 7, a tie plate 20 is shown within the distribution zone 52, defined by the plurality of structures 55. The tie plate 20 is past the first stop position on the opposite side of stop 54 and is engaging the second stop 70. The actuator was previously in an upper position to allow the tie plate 20 move into the depicted position. At the time of the process, the stop 54 is moving down to block any further tie plates from moving into the distribution zone. Further, the magnet 80 is shown engaging the tie plate 20.

Further, the second stops 70 are in a blocking position so that the tie plate 20 cannot move downward. As previously discussed, tie plates 20 may be directed in various directions and according to the depicted embodiment, the downward direction is the direction that tie plates are moved out of the distribution zone 52. Other directions may be used, and likewise, other directions for the blocking direction may be utilized as alternatives to the bottom supporting position of the second stop 70.

Referring to FIG. 8, the actuator 60 is moved downwardly from FIG. 7, as indicated by the double line downward arrow. In the instant embodiment, the actuator 60 has actuated to push the tie plate 20 downward. As this occurs, the tie plate is forced downward and causes the second stop 70, embodied in non-limiting fashion by the supports 72, to rotate toward an unblocking position.

As the tie plate 20 continues moving, the tie plate eventually disengages the second stop 70, so that the biasing force of the springs 62 will begin moving the second stop 70 to its position shown in FIG. 8. This position is an optional third stop 82, if an optional magnet 80 is used and the tie plate 20 is held in a position by a magnet 80 before release.

In the depicted position, the tie plate 20 may fall toward the railroad track system, for example the railroad tie 18. However, in other optional embodiments, including one where the magnet 80 is utilized, the tie plate 20 may be retained or held until the distribution zone is in a desired position.

Referring now to FIG. 9, the tie plate 20 is pushed through the second stop 70 and is falling. In this example, if the optional magnet 80 is used, the magnet 80 has released the tie plate 20. Also, the second stop 70 is retracted to a position shown in FIG. 7, so that the tie plate 20 may be received therein.

With the second stop 70 retracted, the actuator 60 can subsequently lift to allow a next sequential tie plate 20 to move into the distribution zone 52 of the tie plate distributor 12.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A tie plate distributor, comprising:

a distribution zone;

a conveyor having a first end and a second end, wherein said distribution zone is located near said second end;

said conveyor capable of moving a tie plate from said first end to said distribution zone;

an actuator positioned near said distribution zone which moves said tie plate from said distribution zone past a stop and on to a railroad tie or ballast; and, said stop comprising at least one support and being biased independently of said actuator.

2. The tie plate distributor of claim 1, said at least one support moving between an open position and a closed position.

3. The tie plate distributor of claim 2, said at least one support comprising a first support and a second support.

4. The tie plate distributor of claim 2 further comprising a biasing spring which biases said at least one support.

5. The tie plate distributor of claim 2, said moving being a pivoting movement.

6. The tie plate distributor of claim 1, further comprising a conveyor stop which limits stops a plurality of tie plates on said conveyor and allows only one said tie plate into said distribution zone.

7. The tie plate distributor of claim 1 further comprising a magnet disposed on said actuator.

8. The tie plate distributor of claim 7, said magnet retaining said tie plate on said actuator and releasing said tie plate when said tie plate passes by said at least one support.

9. A method of distributing tie plates, comprising the steps of:

providing a tie plate distributor for operation along a railroad;

providing a first stop between a conveyor and a distribution zone;

providing a second stop at said distribution zone, said second stop being movable between a first position and a second position;

providing an actuator near said distribution zone;

moving one tie plate of said tie plates from said distribution zone to said railroad.

10. The method of claim 9, further comprising actuating one or both of said one tie plate or said second stop to perform said moving.

11. The method of claim 9, further comprising providing a biasing force on said second stop to retain the second stop in a normally closed position.

12. The method of claim 9 further comprising providing said conveyor and said tie plates on said conveyor.

13. The method of claim 12, locating said distribution zone at an end of said conveyor.

14. The method of claim 9, further comprising providing a magnet on said actuator.

15. The method of claim 14, further comprising releasing said one tie plate from said actuator when said one tie plate is past said second stop.

16. A method of distributing tie plates, comprising the steps of:

providing a conveyor capable of moving a plurality of tie plates from a first end to a second end;

providing a distribution zone near said second end of said conveyor;

providing a stop at said distribution zone;

biasing said stop to one position;

providing an actuator near the stop to move one tie plate of said plurality of tie plates;

moving said one tie plate from said distribution zone.

17. The method of claim 16, said biasing being by one of a spring, electrical actuator, pneumatic actuator, or a hydraulic actuator.

18. The method of claim 16, said actuator moving said one tie plate through said distribution zone.

19. The method of claim 18, providing a magnet on said actuator.

* * * * *